US011725572B2

(12) United States Patent
Dahl et al.

(10) Patent No.: US 11,725,572 B2
(45) Date of Patent: Aug. 15, 2023

(54) METHOD AND SYSTEM FOR AN ON BOARD COMPRESSOR

(71) Applicant: Ford Global Technologies, LLC, Dearborn, MI (US)

(72) Inventors: Colby Dahl, Saline, MI (US); Douglas Martin, Canton, MI (US); Matthew Ryan Preston, Whitmore Lake, MI (US); John Rollinger, Troy, MI (US); Shriram Siravara, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/645,255

(22) Filed: Dec. 20, 2021

(65) Prior Publication Data

US 2023/0193813 A1 Jun. 22, 2023

(51) Int. Cl.

| | |
|---|---|
| ***F02B 37/00*** | (2006.01) |
| ***F04B 49/22*** | (2006.01) |
| ***F04B 41/02*** | (2006.01) |
| ***F04B 35/00*** | (2006.01) |

(52) U.S. Cl.

CPC ..... *F02B 37/005* (2013.01); *F04B 35/002* (2013.01); *F04B 41/02* (2013.01); *F04B 49/22* (2013.01)

(58) Field of Classification Search

CPC ..... F02B 37/005; F04B 35/002; F04B 41/02; F04B 41/04; F04B 49/22

See application file for complete search history.

(56) References Cited

U.S. PATENT DOCUMENTS

| | | | | |
|---|---|---|---|---|
| 4,502,848 | A * | 3/1985 | Robertson | F04B 35/002 417/399 |
| 4,884,405 | A * | 12/1989 | Schatz | F01B 11/007 60/605.1 |
| 6,829,892 | B2 | 12/2004 | Larson | |
| 2012/0294730 | A1* | 11/2012 | Kline | F04B 41/02 417/1 |
| 2016/0215684 | A1* | 7/2016 | Hofmann | F02B 33/32 |

FOREIGN PATENT DOCUMENTS

| | | | |
|---|---|---|---|
| DE | 10149394 | A1 | 4/2003 |
| DE | 102019132783 | A1 | 10/2020 |
| GB | 2403772 | A | 1/2005 |

OTHER PUBLICATIONS

Flexachem, Diaphragm Pump, May 17, 2021, https://www.flexachem.com/pumps/positive-displacement-pump/diaphragm-pump/.*

Martin, D. et al., "Methods and Systems for Compressed Air System," U.S. Appl. No. 17/180,569, filed Feb. 19, 2021, 33 pages.

Dahl, C. et al., "Method and System for Compressed Air Supply," U.S. Appl. No. 17/650,040, filed Feb. 4, 2022, 36 pages.

Dahl, C. et al., "Method and System for Compressed Air Supply," U.S. Appl. No. 17/650,042, filed Feb. 4, 2022, 36 pages.

* cited by examiner

*Primary Examiner* — Ngoc T Nguyen

(74) *Attorney, Agent, or Firm* — Vincent Mastrogiacomo; McCoy Russell LLP

(57) ABSTRACT

Methods and systems to provide compressed air via exhaust gases of an internal combustion engine are presented. In one example, a pump comprising two pistons is driven via engine exhaust gases. On piston within the pump moves in response to the exhaust gases while the other piston acts to compress air.

19 Claims, 4 Drawing Sheets

METHOD AND SYSTEM FOR AN ON BOARD COMPRESSOR

FIELD

The present application relates to methods and systems for generating compressed air aboard a vehicle that includes an internal combustion engine.

BACKGROUND/SUMMARY

Compressed air may be a preferred form of energy for some applications. For example, in building trades, compressed air may be applied to operate nail guns, staplers, paint sprayers, chippers, and air hammers. The compressed air may be more suitable for operating tools in wet environments, hot environments, and environments where there may be large amounts of dust. Air operated tools may have advantages including being lighter, lower in cost, and having a greater power to weight ratio as compared to electrically operated tools. However, towing a compressor to a job site may be inconvenient and some compressors may be electrically powered. Thus, an electric power source may have to be brought with the compressor to operate the compressor. Consequently, some of the advantages of air operated tools may be reduced depending on resources that may be available at a job site and ancillary devices that may have to be leveraged to operate air powered tools.

The inventors herein have recognized the challenges that may be associated with operating air operated devices and have developed a method for providing air power to one or more air consumers, comprising: supplying an exhaust gas from an internal combustion engine to a pump; and compressing air via the pump.

By applying energy from engine exhaust gases to generate compressed air, it may be possible to provide compressed air without towing a compressor or using an electric power source to drive a compressor. In particular, a pump may be included within a vehicle that operates on exhaust gas energy. Consequently, a user need not tow a compressor or find an electric power source for driving the compressor. As such, utility of a vehicle may be enhanced and customer satisfaction may be improved.

The present approach may provide several advantages. Specifically, the approach may provide compressed air without having to tow an auxiliary power device. Further, the approach may be integrated into a vehicle to allow convenient operation of air powered devices. In addition, the approach may be applied to vehicles that include V and inline engines.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
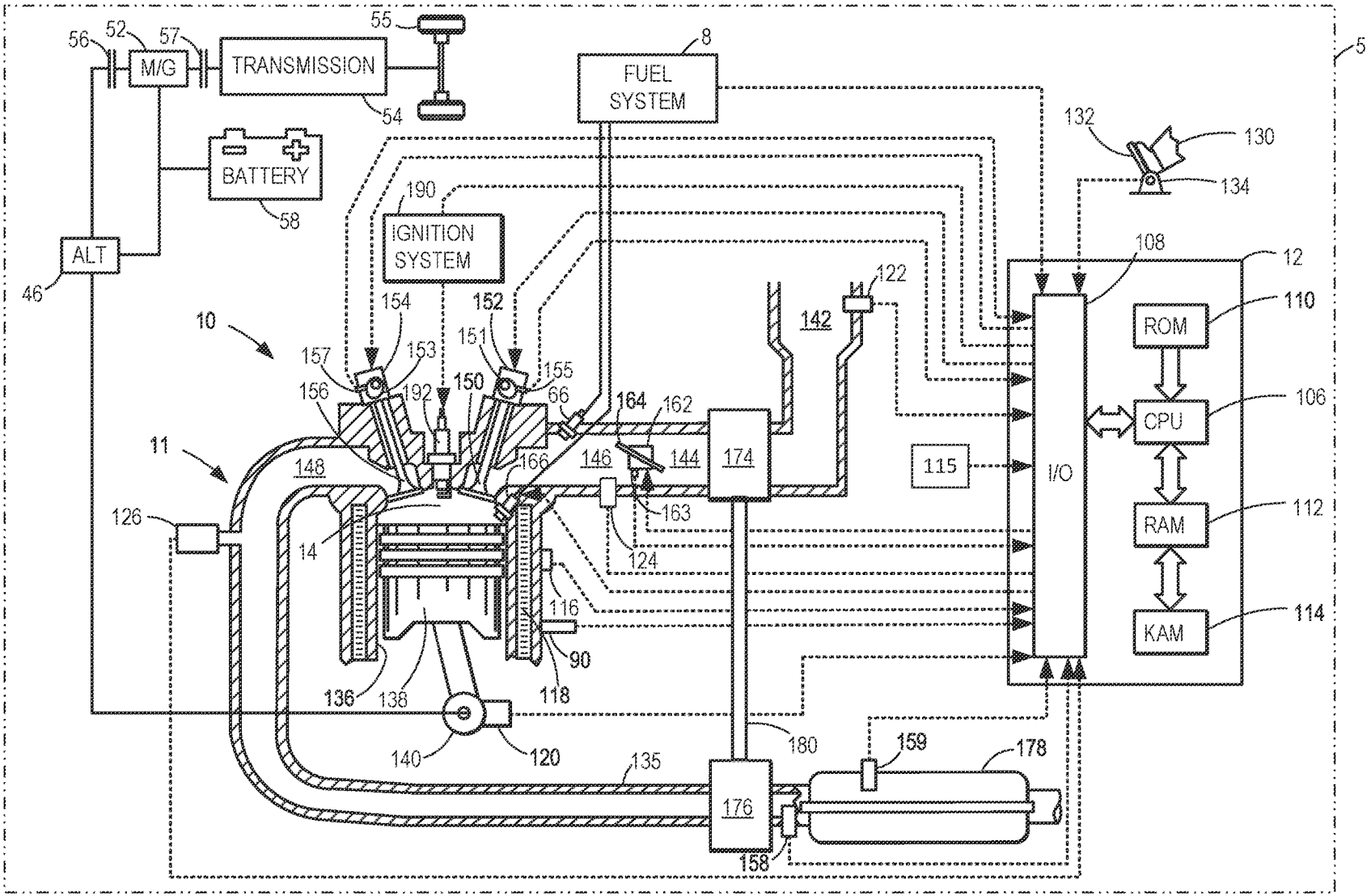
FIG. 1 shows a schematic depiction of an engine system of a vehicle.
Figure 2:
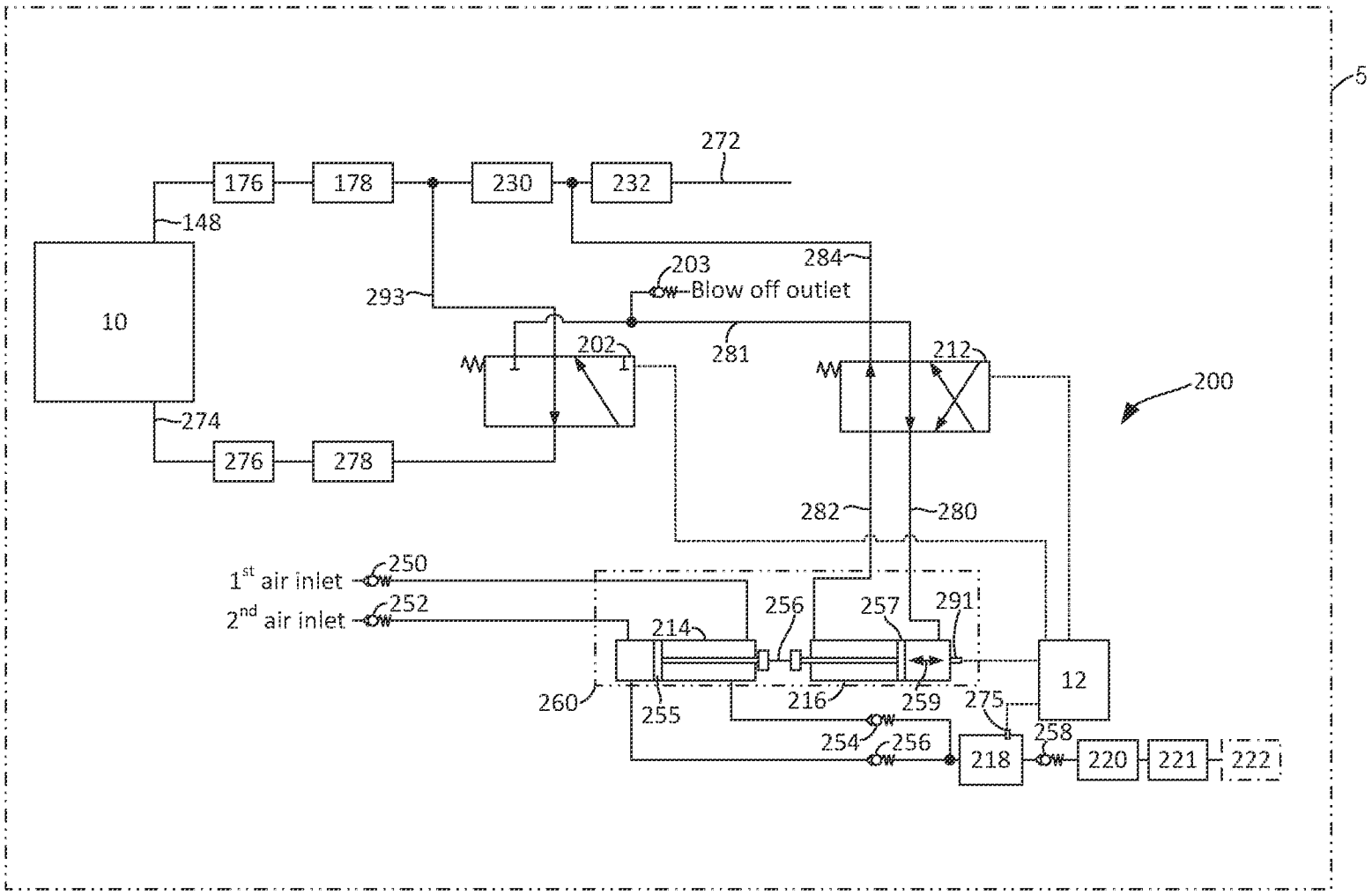
FIG. 2 shows an example exhaust powered air compressor.
Figure 3:
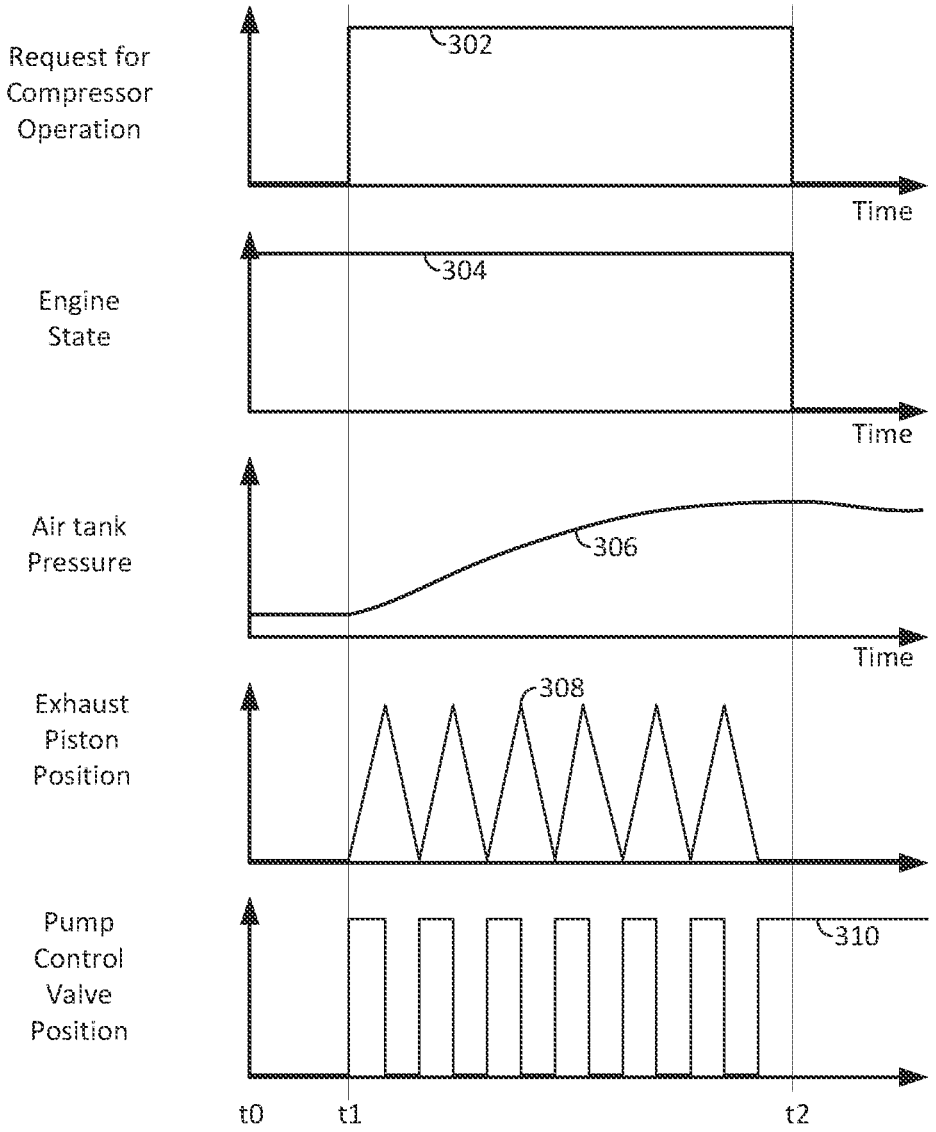
FIG. 3 shows an operating sequence for an exhaust powered air compressor.
Figure 4:
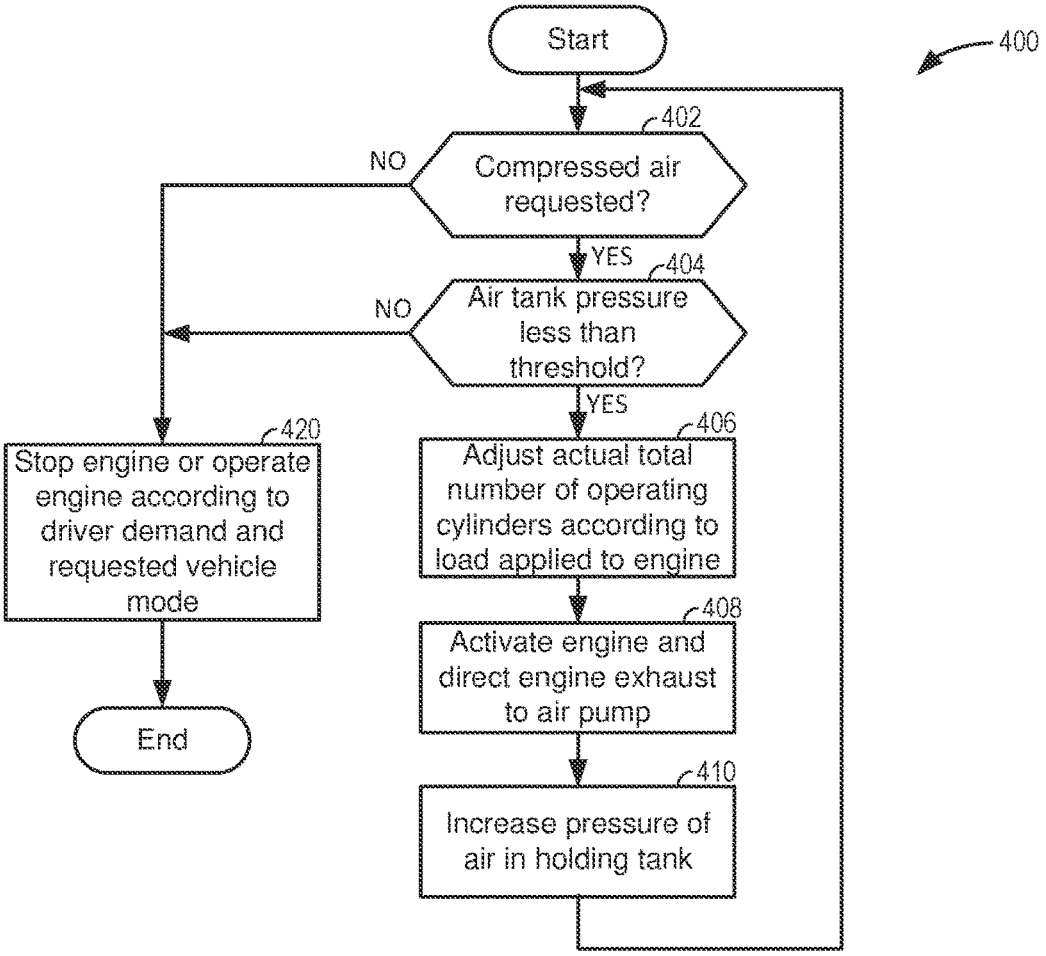
FIG. 4 shows a flowchart of a method for operating an exhaust powered air compressor.

The following description relates to systems and methods for generating compressed air for powering devices that consume compressed air. The compressed air may be generated from exhaust gases of an engine. In particular, the exhaust gases of the engine may be applied to operate a pump. The pump may pressurize air and the pressurized air may be stored in a tank. The pump may be included in a vehicle as shown in FIG. 1. The pump may be coupled to an exhaust system of an engine as shown in FIG. 2. The pump may be operated as shown in FIG. 3 according to the method of FIG. 4. A method for converting energy from engine exhaust into compressed air is shown in FIG. 4.

Turning now to the figures, FIG. 1 depicts an example of a cylinder 14 of an internal combustion engine 10, which may be included in a vehicle 5. Engine 10 may be a variable displacement engine (VDE), as described further below. Engine 10 may be controlled at least partially by a control system, including a controller 12, and by input from a human vehicle operator 130 via a driver demand pedal 132. In this example, driver demand pedal 132 includes a pedal position sensor 134 for generating a proportional pedal position signal. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 of vehicle 5 via a transmission 54, as further described below.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 57 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

Engine 10 may be rotated via electric machine 52 during starting or when engine 10 is operated as an air pump. Alternatively, a starter motor (not shown) may rotate engine 10 during starting or when engine 10 is operated as an air pump. The starter motor may engage crankshaft 140 via a flywheel (not shown).

The powertrain may be configured in various manners, including as a parallel, a series, or a series-parallel hybrid vehicle. Further, engine 10 and electric machine 52 may be coupled via a gear set instead of a clutch in some configurations. In electric vehicle examples, a system battery 58 may be a traction battery that delivers electrical power to electric machine 52 to provide torque to vehicle wheels 55. In some examples, electric machine 52 may also be operated as a generator to provide electrical power to charge system battery 58, for example, during a braking operation. It will be appreciated that in other examples, including non-electric vehicle examples, system battery 58 may be a typical starting, lighting, ignition (SLI) battery coupled to an alternator 46.

Alternator 46 may be configured to charge system battery 58 using engine torque via crankshaft 140 during engine running. In addition, alternator 46 may power one or more electrical systems of the engine, such as one or more auxiliary systems including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based upon system usage requirements, including auxiliary system demands.

Cylinder 14 of engine 10 can receive intake air via a series of intake passages 142 and 144 and an intake manifold 146. Intake manifold 146 can communicate with other cylinders of engine 10 in addition to cylinder 14. One or more of the intake passages may include one or more boosting devices, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted. In still other examples, engine 10 may be provided with an electric supercharger (e.g., an "eBooster"), and compressor 174 may be driven by an electric motor. In still other examples, engine 10 may not be provided with a boosting device, such as when engine 10 is a naturally aspirated engine.

A throttle 162 including a throttle plate 164 may be provided in the engine intake passages for varying a flow rate and/or pressure of intake air provided to the engine cylinders. For example, throttle 162 may be positioned downstream of compressor 174, as shown in FIG. 1, or may be alternatively provided upstream of compressor 174. A position of throttle 162 may be communicated to controller 12 via a signal from a throttle position sensor.

An exhaust manifold 148 can receive exhaust gases from other cylinders of engine 10 in addition to cylinder 14. An exhaust gas sensor 126 is shown coupled to exhaust manifold 148 upstream of an emission control device 178. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO sensor. Emission control device 178 may be a three-way catalyst, a NOx trap, various other emission control devices, or combinations thereof. In the example of FIG. 1, emission control device 178 may be a three-way catalyst or an oxidation catalyst. Exhaust manifold 148, emissions control device 178, exhaust gas sensor 126, and temperature sensors may be included in engine exhaust system 11.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. In this example, intake valve 150 may be controlled by controller 12 by cam actuation via cam actuation system 152, including one or more cams 151. Similarly, exhaust valve 156 may be controlled by controller 12 via cam actuation system 154, including one or more cams 153. The position of intake valve 150 and exhaust valve 156 may be determined by valve position sensors (not shown) and/or camshaft position sensors 155 and 157, respectively.

During some conditions, controller 12 may vary the signals provided to cam actuation systems 152 and 154 to control the opening and closing of the respective intake and exhaust valves. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of variable displacement engine (VDE), cam profile switching (CPS), variable cam timing (VCT), variable valve timing (VVT), and/or variable valve lift (VVL) systems that may be operated by controller 12 to vary valve operation. In alternative examples, intake valve 150 and/or exhaust valve 156 may be controlled by electric valve actuation. For example, cylinder 14 may alternatively include an intake valve controlled via electric valve actuation and an exhaust valve controlled via cam actuation, including CPS and/or VCT systems. In other examples, the intake and exhaust valves may be controlled by a common valve actuator (or actuation system) or a variable valve timing actuator (or actuation system).

As further described herein, intake valve 150 and exhaust valve 156 may be deactivated during VDE mode via electrically actuated rocker arm mechanisms. In another example, intake valve 150 and exhaust valve 156 may be deactivated via a CPS mechanism in which a cam lobe with no lift is used for deactivated valves. Still other valve deactivation mechanisms may also be used, such as for electrically actuated valves. In one example, deactivation of intake valve 150 may be controlled by a first VDE actuator (e.g., a first electrically actuated rocker arm mechanism, coupled to intake valve 150) while deactivation of exhaust valve 156 may be controlled by a second VDE actuator (e.g., a second electrically actuated rocker arm mechanism, coupled to exhaust valve 156). In alternate examples, a single VDE actuator may control deactivation of both intake and exhaust valves of the cylinder. In still other examples, a single cylinder valve actuator deactivates a plurality of cylinders (both intake and exhaust valves), such as all of the cylinders in an engine bank, or a distinct actuator may control deactivation for all of the intake valves while another distinct actuator controls deactivation for all of the exhaust valves of the deactivated cylinders. It will be appreciated that if the cylinder is a non-deactivatable cylinder of the VDE engine, then the cylinder may not have any valve deactivating actuators. Each engine cylinder may include the valve control mechanisms described herein. Intake and exhaust valves are held in closed positions over one or more engine cycles when deactivated so as to prevent flow into or out of cylinder 14.

Cylinder 14 can have a compression ratio, which is a ratio of volumes when piston 138 is at bottom dead center (BDC) to top dead center (TDC). In one example, the compression ratio is in the range of 9:1 to 22:1, depending on whether engine 10 is configured as a gasoline or diesel engine. The compression ratio may also be increased if direct injection is used due to its effect on engine knock.

Each cylinder of engine 10 may include a spark plug 192 for initiating combustion when the engine is configured to combust gasoline or petrol. However, spark plug 192 may be omitted when engine 10 is configured to combust diesel fuel. An ignition system 190 can provide an ignition spark to combustion chamber 14 via spark plug 192 in response to a spark advance signal from controller 12, under select operating modes. Spark timing may be adjusted based on engine operating conditions and driver torque demand. For example, spark may be provided at minimum spark advance for best torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, spark may be retarded from MBT, such as to expedite catalyst warm-up during engine start or to reduce an occurrence of engine knock.

In some examples, each cylinder of engine 10 may be configured with one or more fuel injectors for providing fuel thereto. As a non-limiting example, cylinder 14 is shown including a direct fuel injector 166 and a port fuel injector 66. Fuel injectors 166 and 66 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal received from controller 12. Port fuel injector 66 may be controlled by controller 12 in a similar way. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injectors 166 and 66 from a fuel tank of fuel system 8 via fuel pumps and fuel rails. Further, the fuel tank may have a pressure transducer providing a signal to controller 12.

Fuel injectors 166 and 66 may be configured to receive different fuels from fuel system 8 in varying relative amounts as a fuel mixture and further configured to inject this fuel mixture directly into cylinder. For example, fuel injector 166 may receive alcohol fuel and fuel injector 66 may receive gasoline. Further, fuel may be delivered to cylinder 14 during different strokes of a single cycle of the cylinder. For example, directly injected fuel may be delivered at least partially during a previous exhaust stroke, during an intake stroke, and/or during a compression stroke. Port injected fuel may be injected after intake valve closing of a previous cycle of the cylinder receiving fuel and up until intake valve closing of the present cylinder cycle. As such, for a single combustion event (e.g., combustion of fuel in the cylinder via spark ignition or compression ignition), one or multiple injections of fuel may be performed per cycle via either or both injectors. The multiple DI injections may be performed during the compression stroke, intake stroke, or any appropriate combination thereof in what is referred to as split fuel injection.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; a catalyst inlet temperature from a temperature sensor 158 coupled to exhaust passage 135; a catalyst temperature from temperature sensor 159; a crankshaft position signal from a Hall effect sensor 120 (or other type) coupled to crankshaft 140; throttle position from a throttle position sensor 163; signal UEGO from exhaust gas sensor 126, which may be used by controller 12 to determine the air-fuel ratio of the exhaust gas; engine vibrations via sensor 90; and an absolute manifold pressure signal (MAP) from a MAP sensor 124. An engine speed signal, RPM, may be generated by controller 12 from crankshaft position. The manifold pressure signal MAP from MAP sensor 124 may be used to provide an indication of vacuum or pressure in the intake manifold. Controller 12 may infer an engine temperature based on the engine coolant temperature.

Controller 12 receives signals from the various sensors of FIG. 1 and employs the various actuators of FIG. 1 to adjust engine operation based on the received signals and instructions stored on a memory of the controller. For example, the controller may transition the engine to operating in VDE mode by actuating valve actuators 152 and 154 to deactivate selected cylinders. In addition, controller 12 may receive input from and provide data to human/machine interface 115. In one example, human/machine interface 115 may be a touch screen device, a display and keyboard, a phone, or other known device.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

During selected conditions, such as when the full torque capability of engine 10 is not requested, one of a first or a second cylinder group may be selected for deactivation by controller 12 (herein also referred to as a VDE mode of operation). During the VDE mode, cylinders of the selected group of cylinders may be deactivated by shutting off respective fuel injectors 166 and 66. Further, valves 150 and 156 may be deactivated and held closed over one or more entire engine cycles. While fuel injectors of the disabled cylinders are turned off, the remaining enabled cylinders continue to carry out combustion, with corresponding fuel injectors and intake and exhaust valves active and operating. To meet torque requirements, the controller adjusts the amount of air entering active engine cylinders. Thus, to provide equivalent engine torque that an eight cylinder engine produces at 0.2 engine load and a particular engine speed, the active engine cylinders may operate at higher pressures than engine cylinders when the engine is operated with all engine cylinders being active. This requires higher manifold pressures, resulting in lowered pumping losses and increased engine efficiency. Additionally, the lower effective surface area (from only the active cylinders) exposed to combustion reduces engine heat losses, increasing the thermal efficiency of the engine.

Referring now to FIG. 2, a detailed view of an air compressor for a vehicle is shown. Devices and mechanical connections (e.g., conduits or passages) are shown as solid lines and electrical connections are shown as dotted lines. In this example, engine 10 is configured with two cylinder banks (e.g., a V6 or a V8).

Exhaust manifold 148 may deliver exhaust gases from engine 10 to turbine 176 and catalyst 178. Similarly, exhaust manifold 274 may deliver exhaust gases from engine 10 to turbine 276 and catalyst 278. When compressor system 200 is not activated, exhaust gases leaving catalyst 278 may pass through diverter valve 202 when diverter valve 202 is in a first position as shown and through exhaust passage 293. Diverter valve 202 prevents flow of exhaust gases to pump 260 when diverter valve 202 is in the first position. Exhaust gases pass through exhaust passage 293 and enter catalyst 230. Exhaust gases flow through muffler 232 and exit to atmosphere via exhaust passage 272.

Controller 12 may activate compressor system 200 via starting engine 10, if engine 10 is not already started, and moving diverter valve 202 to its second position. Exhaust gases may flow through diverter valve 202, exhaust passage 281, pump control valve 212, and into pump 260 when diverter valve 202 is in its second position. Exhaust gases may flow to one side of cylinder 216 when pump control valve 212 is in a first position. Exhaust gases may flow to the other side of cylinder 216 when pump control valve 212 is in a second position. Cycling delivery of exhaust gases between the two sides of cylinder 216 via adjusting the position of pump control valve 212 may cause piston 257 (which may be referred to as an exhaust piston since it moves via exhaust pressure) to cycle back and forth as indicated by arrow 259. Piston 257 is cycled via exhaust and cycling piston 257 causes piston 255 (which may be referred to as an air piston since it pumps air) to cycle in cylinder 214 so as to compress air that may enter through the Pt air inlet or the 2' air inlet. Piston 257 is directly coupled to piston 255 via shaft 256. Only exhaust gases may enter cylinder 216 while only air may enter cylinder 214. In this way, exhaust gases may be isolated from air that enters pump 260. Exhaust gases exit pump 260 and return through pump control valve 212 before returning to the main exhaust exit passage 272 via exhaust passage 284. Thus, exhaust flows into and out of cylinder 216 in an alternating fashion via exhaust passages 282 and 280. Controller 12 may adjust a position of piston control valve in response to piston position sensor 291. Check valves 250 and 252 permit air to enter pump 260 and prevent air from exiting pump 260. Pressurized air may be delivered to optional tank from cylinder 214 via check valves 254 and 256. Check valves 254 and 256 prevent air from flowing back to cylinder 214. Controller 12 may cycle pump control valve 212 in response to pressure in tank 218 as observed via pressure sensor 275. Air may flow to air power consumer 222 via pressure regulator 220 and coupling 221. Check valve 258 prevents air from flowing into tank 218 from coupling 221. A blow off outlet may also be provided via check valve 203 so that exhaust pressure may be relieved, if desired.

Thus, the system of FIGS. 1 and 2 provides for a system for supplying compressed air from a vehicle, comprising: an internal combustion engine including an exhaust system; a pump in pneumatic communication with the exhaust system; and a controller including executable instructions stored in non-transitory memory that cause the controller to adjust a position of a piston of the pump via adjusting a position of a valve that selectively changes a direction of exhaust flow to the pump. The system includes where adjusting the position of the piston causes the pump to compress air. The system further comprises additional instructions to adjust the position of the valve based on a position of the piston. The system further comprises additional instructions to adjust one or more exhaust valves to direct engine exhaust to the valve and the pump. The system includes where the pump includes two pistons. The system further comprises a tank pneumatically coupled to the pump. The system further comprises a pressure regulator pneumatically coupled to the tank.

The system of FIGS. 1 and 2 also provides for a system for supplying compressed air from a vehicle, comprising: an internal combustion engine including an exhaust system; a pump in pneumatic communication with the exhaust system and two air inlet passages; and a tank in pneumatic communication with the pump. The system includes where the pump is in pneumatic communication with the exhaust system via at least one two-position diverter valve and at least one two-position pump control valve. The system further comprises a controller including executable instructions stored in non-transitory memory to move a position of the at least one diverter valve in response to a request to generate compressed air. The system further comprises additional executable instructions stored in non-transitory memory to adjust a position of at least one two-position pump control valve. The system includes where the pump includes two pistons that are coupled together.

Referring now to FIG. 3, an example pump operating sequence for a compressor that is driven via engine exhaust gases is shown. The sequence of FIG. 3 may be provided by the system of FIGS. 1 and 2 in cooperation with the method of FIG. 4. The vertical lines at times t0-t2 represent times of interest in the sequence.

The first plot from the top of FIG. 3 is a plot of a request for compressor operation versus time. The vertical axis represents the request for compressor operation and compressor operation is requested when trace 302 is at a higher level near the vertical axis arrow. Operation of the compressor is not requested when trace 302 is at a lower level near the horizontal axis. The horizontal axis represents time and time increases from the left side of the plot to the right side of the plot. Trace 302 represents the request for compressor operation.

The second plot from the top of FIG. 3 is a plot of an engine operating state versus time. The vertical axis represents the engine operating state and the engine operating state indicates that the engine is active (e.g., rotating and combusting fuel) when trace 304 is at a higher level near the vertical axis arrow. The engine is not active when trace 304 is at a lower level near the horizontal axis. The horizontal axis represents time and time increases from the left side of the plot to the right side of the plot. Trace 304 represents the engine operating state.

The third plot from the top of FIG. 3 is a plot of air tank pressure versus time. The vertical axis represents air tank pressure and the air tank pressure increases in the direction of the vertical axis arrow. The horizontal axis represents time and time increases from the left side of the plot to the right side of the plot. Trace 306 represents the air tank pressure.

The fourth plot from the top of FIG. 3 is a plot of piston position versus time. The vertical axis represents the position of piston 257. The horizontal axis represents time and time increases from the left side of the plot to the right side of the plot. Trace 308 represents piston position.

The fifth plot from the top of FIG. 3 is a plot of pump control valve position versus time. The vertical axis represents the position of pump control valve 212. The horizontal axis represents time and time increases from the left side of the plot to the right side of the plot. Trace 310 represents the pump control valve position.

At time t0, the request for compressor operation is not asserted and the engine is running. The air tank pressure is low and the exhaust piston position is not changing. The pump control valve position is not changing.

At time t1, the request for compressor operation is asserted and the pump control valve position is changed to allow exhaust gas to move the exhaust piston. The engine remains running and pressure in the tank begins to build. The exhaust valve position begins to change when exhaust pressure begins to work on the exhaust piston.

Between time t1 and time t2, the pump control valve position is changed so that the exhaust piston may cycle back and forth between extents of cylinder 216, which causes air piston 255 to pressurize air and store the pressurized air in tank 218. Each time exhaust piston 257 approaches an end of cylinder 216, the position of pump control valve 212 is adjusted to reverse the flow of exhaust into cylinder 216 and continue the pumping action.

At time t2, the request for compressor operation is withdrawn and the pump control valve position is held stopped to prevent movement of the exhaust piston. The engine is stopped in this example since compressed air is no longer needed and vehicle movement is not requested (not shown).

In this way, compressed air may be generated via power that is produced from engine exhaust gases. In particular, exhaust gases are applied to move a piston and the piston moves a second piston that compresses air. The compressed air may then be applied to operate devices that consume compressed air.

Referring now to FIG. 4, a method for generating compressed air via exhaust gas energy from a vehicle is shown. Method 400 may be included in and may cooperate with the system of FIGS. 1 and 2. At least portions of method 400 may be incorporated in the system of FIGS. 1 and 2 as executable instructions stored in non-transitory memory. In addition, other portions of method 400 may be performed via a controller transforming operating states of devices and actuators in the physical world. The controller may employ actuators and sensors described herein to adjust engine coolant pump operation. Further, method 400 may determine selected control parameters from sensor inputs.

At 402, method 400 judges if compressed air is requested from the vehicle. Compressed air may be requested via a human/machine interface or automatically in response to a low pressure in an air tank. If method 400 judges that compressed air is requested, the answer is yes and method 400 proceeds to 404. Otherwise, the answer is no and method 400 proceeds to 420. At 420, method 400 may stop the engine (e.g., stop engine rotation and combustion within the engine) or the engine may continue to operate according to driver demand torque and a requested vehicle operating mode. The engine may continue to operate if the vehicle is being driven while the compressed air is being generated. The engine may be stopped to conserve fuel if the vehicle is parked and the engine is being applied to only generate compressed air and not provide propulsive effort. Method 400 proceeds to exit.

At 404, method 400 judges if a pressure in an air storage tank (e.g., 218) is less than a threshold pressure. If so, the answer is yes and method 400 proceeds to 406. Otherwise, the answer is no and method 400 proceeds to 420.

At 406, method 400 adjusts the actual total number of active cylinders (e.g., cylinders that are combusting air and fuel) according to the load that is applied to the engine and compressed air being requested. For example, if the vehicle is parked and not being driven, method 400 may adjust engine speed to a particular predetermined engine speed and load (e.g., 2500 RPM and 0.4 load). However, if compressed air is being generated by the engine when the vehicle is being driven, method 400 may adjust engine torque based on driver demand torque and the request to generate compressed air. Thus, if the engine is an eight cylinder engine and the vehicle is not being driven, four of the engine's cylinders may be activated while four other engine cylinders are not activated. The poppet valves of the deactivated cylinders may be held closed over an entire engine cycle to improve catalyst efficiency. Method 400 may active selected engine cylinders based on the load that is applied to the engine and the amount of compressed air that may be requested. The total number of activated cylinders may increase as an amount of requested compressed air is increased. Method 400 proceeds to 408.

At 408, method 400 activates or starts the engine, if the engine is not started, and directs exhaust to a pump (e.g., 260). In one example, method 400 may move positions of one or more two-position diverter valves (e.g., 202) so that engine exhaust may be delivered to a pump. The engine exhaust gases may then be alternatively directed to different ports of a cylinder (e.g., 216) via a pump control valve (e.g., 212) that is adjusted between a first position and a second position so that an exhaust piston (e.g., 257) is shuttled back and forth in a cylinder (e.g., 216), thereby moving a second piston (e.g., 255) located in a second cylinder (e.g., 214) to compress air in a cylinder. In this way, an exhaust gas driven pump may be activated. Method 400 proceeds to 410.

At 410, method 400 increases air pressure in a tank. The air pressure may be increased via pumping air into the tank via an exhaust driven pump (e.g., 260). Once a threshold pressure is reached, the engine may be stopped and/or the pump control valve (e.g., 212) may be held in a stationary position. Thus, pressure in the tank may be controlled via adjusting the pump control valve in response to a pressure level in the tank. Method 400 returns to 402.

Thus, method 400 may generate air pressure in a tank via a pump that is driven via exhaust gases. The air pressure may be delivered to tools or other air consumers via a coupling or other device that is in communication with the tank.

Method 400 provides for a method for providing air power to one or more air consumers, comprising: supplying an exhaust gas from an internal combustion engine to a pump; and compressing air via the pump. The method further comprises moving a piston of the pump via the exhaust gas. The method includes where the pump includes two pistons and two cylinders. The method includes where a first of the two pistons is mechanically coupled to a second of the two pistons. The method includes where the exhaust gas flows into a first of the two cylinders and where the air flows into a second of the two cylinders. The method includes where compressing the air via the pump includes compressing the air from two air inlets. The method includes where the exhaust gas is supplied from an exhaust system, and where the exhaust system includes a blow off outlet. The method further comprises adjusting a position of a valve to move a piston within the pump.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

Additionally, it should be appreciated that the valves described herein may be replaced with differently configured valves that provide similar functionality without departing from the scope of this disclosure.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for providing air power to one or more air consumers, comprising:

supplying an exhaust gas from an internal combustion engine to a pump; and compressing air via the pump, where the pump includes two pistons and two cylinders.

2. The method of claim 1, further comprising moving a piston of the pump via the exhaust gas and supplying the compressed air to a device via a coupling.

3. The method of claim 1, where compressing the air via the pump includes compressing the air from two air inlets.

4. The method of claim 1, where the exhaust gas is supplied from an exhaust system, and where the exhaust system includes a blow off outlet.

5. The method of claim 1, further comprising adjusting a position of a valve to move a piston within the pump.

6. The method of claim 1, where a first of the two pistons is mechanically coupled to a second of the two pistons.

7. The method of claim 6, where the exhaust gas flows into a first of the two cylinders and where the air flows into a second of the two cylinders.

8. A system for supplying compressed air from a vehicle, comprising:

an internal combustion engine including an exhaust system;

a pump in pneumatic communication with the exhaust system; and a controller including executable instructions stored in non-transitory memory that cause the controller to adjust a position of a piston of the pump via adjusting a position of a valve that selectively changes a direction of exhaust flow to the pump.

9. The system of claim 8, where adjusting the position of the piston causes the pump to compress air.

10. The system of claim 9, further comprising additional instructions to adjust the position of the valve based on a position of the piston.

11. The system of claim 10, further comprising additional instructions to adjust one or more exhaust valves to direct engine exhaust to the valve and the pump.

12. The system of claim 8, where the pump includes two pistons.

13. The system of claim 8, further comprising a tank pneumatically coupled to the pump.

14. The system of claim 13, further comprising a pressure regulator pneumatically coupled to the tank.

15. A system for supplying compressed air from a vehicle, comprising:

an internal combustion engine including an exhaust system;

a pump in pneumatic communication with the exhaust system and two air inlet passages; and a tank in pneumatic communication with the pump.

16. The system of claim 15, where the pump is in pneumatic communication with the exhaust system via at least one two-position pump control valve.

17. The system of claim 16, further comprising a controller including executable instructions stored in non-transitory memory to move a position of at least one two-position exhaust diverter valve in response to a request to generate compressed air.

18. The system of claim 17, further comprising additional executable instructions stored in non-transitory memory to adjust a position of at least one two-position pump control valve.

19. The system of claim 15, where the pump includes two pistons that are coupled together.

* * * * *